US006476325B2

(12) United States Patent
Kondo

(10) Patent No.: US 6,476,325 B2
(45) Date of Patent: Nov. 5, 2002

(54) COMBINATION PLATE TERMINAL ASSEMBLY

(75) Inventor: Masayuki Kondo, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/813,326

(22) Filed: Mar. 21, 2001

(65) Prior Publication Data

US 2001/0025719 A1 Oct. 4, 2001

(30) Foreign Application Priority Data

Mar. 21, 2000 (JP) ..... 2000-078683

(51) Int. Cl.[7] ..... H01R 13/28
(52) U.S. Cl. ..... 174/84 C; 439/287
(58) Field of Search ..... 174/84 C; 439/288, 439/284, 290, 883, 907

(56) References Cited

U.S. PATENT DOCUMENTS 5,558,531 A 9/1996 Ikeda et al. ..... 439/287
5,865,637 A 2/1999 Shinozaki et al. ..... 439/287

FOREIGN PATENT DOCUMENTS

| | | |
|---|---|---|
| JP | 7-85913 | 3/1995 |
| JP | 9-161872 | 6/1997 |
| JP | 10-199598 | 7/1998 |

*Primary Examiner*—Chau N. Nguyen
(74) *Attorney, Agent, or Firm*—Morgan, Lewis & Bockius LLP

(57) ABSTRACT

In a combination plate terminal assembly (shown in FIGS. 1A and 2), each of a pair of base plate portions (7, 8) of one combination plate terminal (2) is provided with one elongated protrusion (11, 12) located substantially intermediately between a pair of retaining portions (9, 10), i.e., located adjacent to a though hole (6) or located adjacent to the retaining portions (9, 10). In a combination plate terminal assembly (shown in FIGS. 3A and 4), retaining portions (9, 32, 19, 33) have different lengths in directions substantially parallel to extending directions of wire connecting portions, and protrusions (38, 39, 40, 41) are disposed parallel to phantom lines (M, N) which respectively connect fulcrums (21, 34) and fulcrums (22, 35) located at the root portions of the retaining portions (9, 32).

12 Claims, 11 Drawing Sheets

RELATED ART

RELATED ART

COMBINATION PLATE TERMINAL ASSEMBLY

BACKGROUND OF THE INVENTION

1. Field of the Invention

The present invention relates to a combination plate terminal assembly capable of combining, in a pair, independent plate terminals respectively crimped onto ends portions of a plurality of electric wires so as to allow the electric wires wired for apparatuses mounted in a vehicle or the like to be collectively connected.

The present application is based on Japanese Patent Application No. 2000-078683, which is incorporated herein by reference.

2. Description of the Related Art

An example of a combination plate terminal assembly is shown in FIGS. 5 to 8. A combination plate terminal assembly 50 shown in FIGS. 5 and 6 is comprised of one combination plate terminal 51 which includes a wire connecting portion 53 to be crimped onto an end portion of an electric wire W and an assembling portion 65 having in its center a through hole 66 through which a tightening bolt is inserted, as well as another combination plate terminal 52 which can be fitted to the one combination plate terminal 51 and is formed in a substantially similar shape.

An assembling portion 55 of the other combination plate terminal 52 has a pair of base plate portions 57 and 58 which are disposed in a direction perpendicular to the axis of the wire W with a through hole 56 positioned therebetween, and which are opposed to and are brought into close contact with a pair of base plate portions 67 and 68 (which will be described later) of the one combination plate terminal 51. Further, the assembling portion 55 of the other combination plate terminal 52 has a pair of retaining portions 61 and 62 which are disposed in a direction parallel to the axis of the wire W with the through hole 56 positioned therebetween and are fitted to a pair of retaining portions 71 and 72 (which will be described later) of the one combination plate terminal 51.

In addition, outer surfaces of the retaining portions 61 and 62 of the other combination plate terminal 52 are formed such that portions between the pair of base plate portions 57 and 58 project in a stepped form toward the one combination plate terminal 51 to such an extent as to form interference fits with respect to inner surfaces of the retaining portions 71 and 72. Further, a pair of elongated protrusions 63 and 64 are respectively provided projectingly on the base plate portions 57 and 58 at positions adjacent to the retaining portion 61.

On the other hand, the assembling portion 65 of the one combination plate terminal 51 has a pair of base plate portions 67 and 68 which are disposed in a direction perpendicular to the axis of the wire W with the through hole 66 positioned therebetween, and which are opposed to and are brought into close contact with the pair of base plate portions 67 and 68 of the other combination plate terminal 52. Further, the assembling portion 65 of the one combination plate terminal 51 has the pair of retaining portions 71 and 72 which are disposed in a direction parallel to the axis of the wire W with the through hole 66 positioned therebetween and are fitted to the pair of retaining portions 61 and 62 of the other combination plate terminal 52.

In addition, the retaining portions 71 and 72 of the one combination plate terminal 51 are formed such that portions between the pair of base plate portions 67 and 68 project in a stepped form toward the other combination plate terminal 52 to such an extent as to form interference fits with respect to the retaining portions 61 and 62. Further, a pair of elongated protrusions 73 and 74 are respectively provided projectingly on opposite surfaces of the base plate portions 67 and 68 at positions adjacent to the other retaining portion 72.

Further, the retaining portions 61, 62, 71, and 72 are respectively provided on both sides thereof with clearance grooves so that the corresponding retaining portions do not interfere with each other during fitting. During fitting, both combination plate terminals 51 and 52 are deflected in a state in which the base plate portions at the innermost portions of the clearance grooves serve as fulcrums 75 to 82.

In addition, as locking mechanisms at the time when the assembling portions 55 and 65 are assembled, the retaining portions 61, 62, 71, and 72 are respectively provided with locking holes 83 and 86 and locking projections 84 and 85.

With the above-described combination plate terminal assembly 50, after one retaining portion 71 of the one combination plate terminal 51 with the rear wire connecting portion 53 crimped onto the end portion of the wire W is fitted in the through hole 56 by being moved along the inner surface of the other retaining portion 62 of the other combination plate terminal 52 with a wire connecting portion 54 crimped onto the end portion of the wire W, the one retaining portion 71 of the one combination plate terminal 51 is continued to be fitted in such a manner as to traverse the through hole 56.

Then, the base plate portions 57 and 58 are respectively slid on the corresponding base plate portions 67 and 68, and the one retaining portion 71 of the one combination plate terminal 51 slips in along the outer surface of the one retaining portion 61 of the other combination plate terminal 52, while the other retaining portion 72 of the one combination plate terminal 51 slips in along the outer surface of the other retaining portion 62 of the other combination plate terminal 52.

Since the retaining portions 61, 62, 71, and 72 are so set as to form interference fits as described above, their assembled state is not easily canceled, and the combination plate terminals 51 and 52 are positively assembled by the action of engagement between the locking projections 84 and 85 and the locking holes 83 and 86.

In that case, since the base plate portions 57, 58, 67, and 68 are provided with the protrusions 63, 64, 73, and 74, as shown in FIG. 6, the base plate portion 57 is deflected at the fulcrums 75 and 77, and the base plate portion 58 is deflected at the fulcrums 76 and 78. In addition, since the base plate portion 67 is similarly deflected at the fulcrums 79 and 81, and the base plate portion 68 at the fulcrums 80 and 82, the state of combination of the combination plate terminals 51 and 52 is further stabilized.

Next, referring to FIGS. 7 and 8, a description will be given of a combination plate terminal assembly 90 which is a modification of the related art. This combination plate terminal assembly 90 has a form in which the lengths, in the direction parallel to the axis of the wire W, of the other retaining portion 62 and the other retaining portion 72 in the above-described combination plate terminal assembly 50 are made short. Namely, the retaining portion 62 and the retaining portion 72 are replaced by a retaining portion 92 of one combination plate terminal 55 and a retaining portion 93 of the other combination plate terminal 65. Accordingly, changes are only made in fulcrums 94, 95, 96, and 97 whose intervals are made shorter than the intervals of the fulcrums 77, 78, 81, and 82 in the above-described combination plate terminal assembly 50, and the other members adopt arrangements equivalent to those of the combination plate terminal assembly 50 shown in FIGS. 5 and 6. Hence, the identical parts and portions will be denoted by the same reference numerals, and a detailed description thereof will be omitted.

However, with the above-described combination plate terminal assembly 50, if variations in the finished dimensions occur to the projecting height of the aforementioned protrusions, the protrusions 63, 64, 73, 74 become out of balance, and there are cases where only one protrusion is brought into contact, resulting in a decrease of the overall contact area. For example, there is a problem in that if the projecting height of the protrusion 73 is low, the load is concentrated on the opposing protrusion 63, with the result that the other protrusions 64 and 74 rattle, thereby making it impossible to obtain stable electrical connection.

In addition, with the combination plate terminal assembly 90, as shown in FIG. 8, the direction of the elongated protrusion 64 does not coincide with the direction of phantom lines M connecting the fulcrums 75 and 94 and the fulcrums 79 and 96, and the direction of the elongated protrusion 63 does not coincide with the direction of phantom lines N connecting the fulcrums 76 and 95 and the fulcrums 80 and 97. For this reason, contact areas T (hatched portions in the drawing) in the protrusions 63 and 64 at the time of fitting and retention and bolting down are not uniformly distributed, so that the variation and reduction of the contact areas occur. As a result, there is a problem in that the protrusions 63 and 64 and the base plate portions 57, 58, 67, and 68 are likely to be deformed, making it impossible to obtain stable electrical contact.

SUMMARY OF THE INVENTION

The present invention is aimed at overcoming the above-described problems of the related art, and its object is to provide a combination plate terminal assembly which makes it possible to obtain satisfactory contact of the protrusions and the base plate portions and stable electrical contact.

To achieve the above object, according to a first aspect of the present invention, there is provided a combination plate terminal assembly which comprises a first combination plate terminal including a first wire connecting portion, to which an end portion of a first electric wire is connectable, a first through hole, through which a tightening bolt is insertable, a pair of first retaining portions, between which the first through hole is located, extending in a direction substantially parallel to an extending direction of the first wire connecting portion, a pair of first base plate portions, between which the first through hole is located, extending in a direction substantially perpendicular to the extending direction of the first wire connecting portion, and at least one first elongated protrusion disposed on one of the first base plate portions.

According to a second aspect of the present invention depending on the first aspect, preferably, the at least one first elongated protrusion is located adjacent to the first through hole.

According to a third aspect of the present invention depending on the first aspect, preferably, the at least one first elongated protrusion is located adjacent to one of the first retaining portions.

According to a fourth aspect of the present invention, the combination plate terminal assembly according to the first aspect further comprises a second combination plate terminal, with which the first combination plate terminal is engageable, including a second wire connecting portion, to which an end portion of a second electric wire is connectable, a second through hole, through which the tightening bolt is insertable, a pair of second retaining portions, between which the second through hole is located, extending in a direction substantially parallel to an extending direction of the second wire connecting portion, and a pair of second base plate portions, between which the second through hole is located, extending in a direction substantially perpendicular to the extending direction of the second wire connecting portion.

According to a fifth aspect of the present invention, the combination plate terminal assembly according to the fourth aspect further comprises at least one second elongated protrusion disposed on one of the second base plate portions.

According to a sixth aspect of the present invention, the combination plate terminal assembly according to the first aspect further comprises at least one second elongated protrusion disposed on the other one of the first base plate portions.

According to a seventh aspect of the present invention depending on the sixth aspect, preferably, the at least one second elongated protrusion is located adjacent to the first through hole.

According to an eighth aspect of the present invention depending on the sixth aspect, preferably, the at least one second elongated protrusion is located adjacent to one of the first retaining portions.

In accordance with any one of the aspects of the present invention, each of the base plate portions of the combination plate terminals, which are engaged by assembling, is pressed at three points including two fulcrums and one protrusion. Accordingly, it is possible to obtain satisfactory contact and stable electrical contact without being affected by the variation of the projecting height of the protrusion.

Furthermore, according to a ninth aspect of the present invention, the combination plate terminal assembly according to the first aspect further comprises a second combination plate terminal, with which the first combination plate terminal is engageable, wherein the at least one first elongated protrusion extends parallel to a first phantom line connecting first fulcrums formed between the first base plate portions and the second combination plate terminal when the first combination plate terminal and the second combination plate terminal are engaged with each other.

According to a tenth aspect of the present invention depending on the ninth aspect, preferably, the second combination plate terminal includes a second wire connecting portion, to which an end portion of a second electric wire is connectable, a second through hole, through which the tightening bolt is insertable, a pair of second retaining portions, between which the second through hole is located, extending in a direction substantially parallel to an extending direction of the second wire connecting portion, and a pair of second base plate portions, between which the second through hole is located, extending in a direction substantially perpendicular to the extending direction of the second wire connecting portion.

According to an eleventh aspect of the present invention, the combination plate terminal assembly according to the tenth aspect further comprises at least one second elongated protrusion disposed on one of the second base plate portions, wherein the at least one second elongated protrusion extends parallel to a second phantom line connecting second fulcrums formed between the first base plate portions and the second base plate portions when the first combination plate terminal and the second combination plate terminal are engaged with each other.

According to a twelfth aspect of the present invention, the combination plate terminal assembly according to the ninth aspect further comprises at least one second elongated protrusion disposed on the other one of the first base plate portions, wherein the at least one second elongated protrusion extends parallel to a second phantom line connecting second fulcrums formed between the first base plate portions and the second combination plate terminal when the first combination plate terminal and the second combination plate terminal are engaged with each other.

According to a thirteenth aspect of the present invention depending on the ninth aspect, preferably, the at least one first elongated protrusion is located adjacent to either one of the first retaining portions.

According to a fourteenth aspect of the present invention depending on the eleventh aspect, preferably, the at least one second elongated protrusion is located adjacent to either one of the second retaining portions.

According to a fifteenth aspect of the present invention depending on the twelfth aspect, preferably, the at least one second elongated protrusion is located adjacent to either one of the first retaining portions.

According to a sixteenth aspect of the present invention depending on the ninth aspect, preferably, when the first combination plate terminal and the second combination plate terminal are engaged with each other, portions of the first base plate portions and the second combination plate terminal adjacent to the first retaining portions serve as the first fulcrums for supporting an engagement of the first combination plate terminal and the second combination plate terminal.

According to a seventeenth aspect of the present invention depending on the eleventh aspect, preferably, portions of the first base plate portions and the second base plate portions adjacent to the first retaining portions and the second retaining portions serve as the first and second fulcrums for supporting an engagement of the first combination plate terminal and the second combination plate terminal.

According to an eighteenth aspect of the present invention depending on the twelfth aspect, preferably, portions of the first base plate portions adjacent to the first retaining portions serve as the first fulcrums for supporting an engagement of the first combination plate terminal and the second combination plate terminal.

According to a nineteenth aspect of the present invention, the combination plate terminal assembly according to the eleventh aspect further comprises a third elongated protrusion disposed on the other one of the first base plate portions, and a fourth elongated protrusion disposed on the other one of the second base plate portions.

According to a twentieth aspect of the present invention, the combination plate terminal assembly according to the twelfth aspect further comprises a third elongated protrusion disposed on the one of the first base plate portions, and a fourth elongated protrusion disposed on the other one of the first base plate portions.

In accordance with any one of the ninth to twentieth aspects of the present invention, the deflecting direction of each of the base plate portion coincides with the direction of each of the protrusions, so that the contact area of the protrusion become uniform, and the load at the time of assembling and bolting down can be distributed uniformly, so that crushing can be minimized. Moreover, since the contact area becomes large, it is possible to obtain satisfactory contact and stable electrical connection.

DETAILED DESCRIPTION OF THE PREFERRED EMBODIMENTS

Preferred embodiments of the present invention now will be described with reference to FIGS. 1A to 4.

Figure 1A:
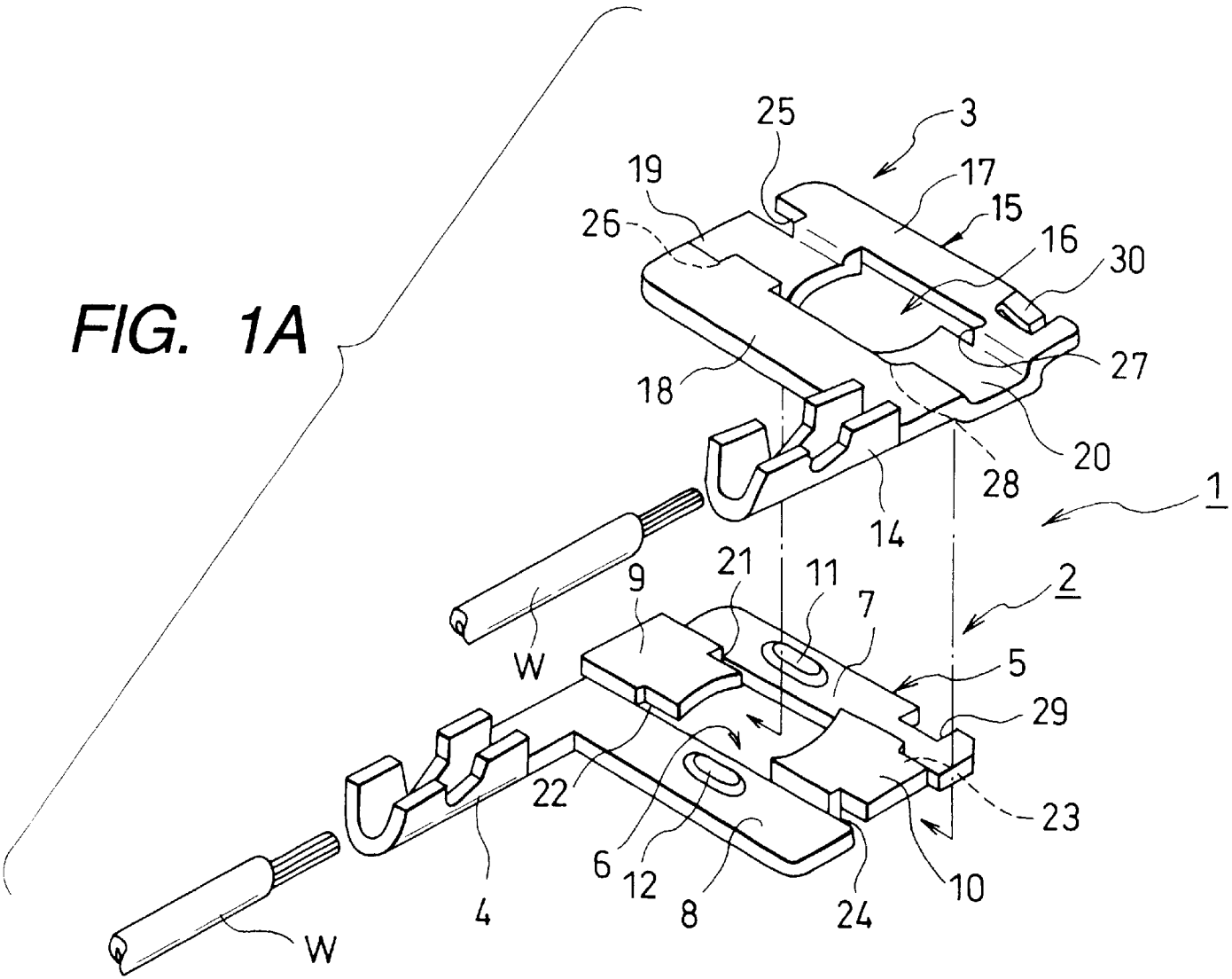
FIG. 1A is an exploded perspective view illustrating a first embodiment of a combination plate terminal assembly according to the present invention.
Figure 2:
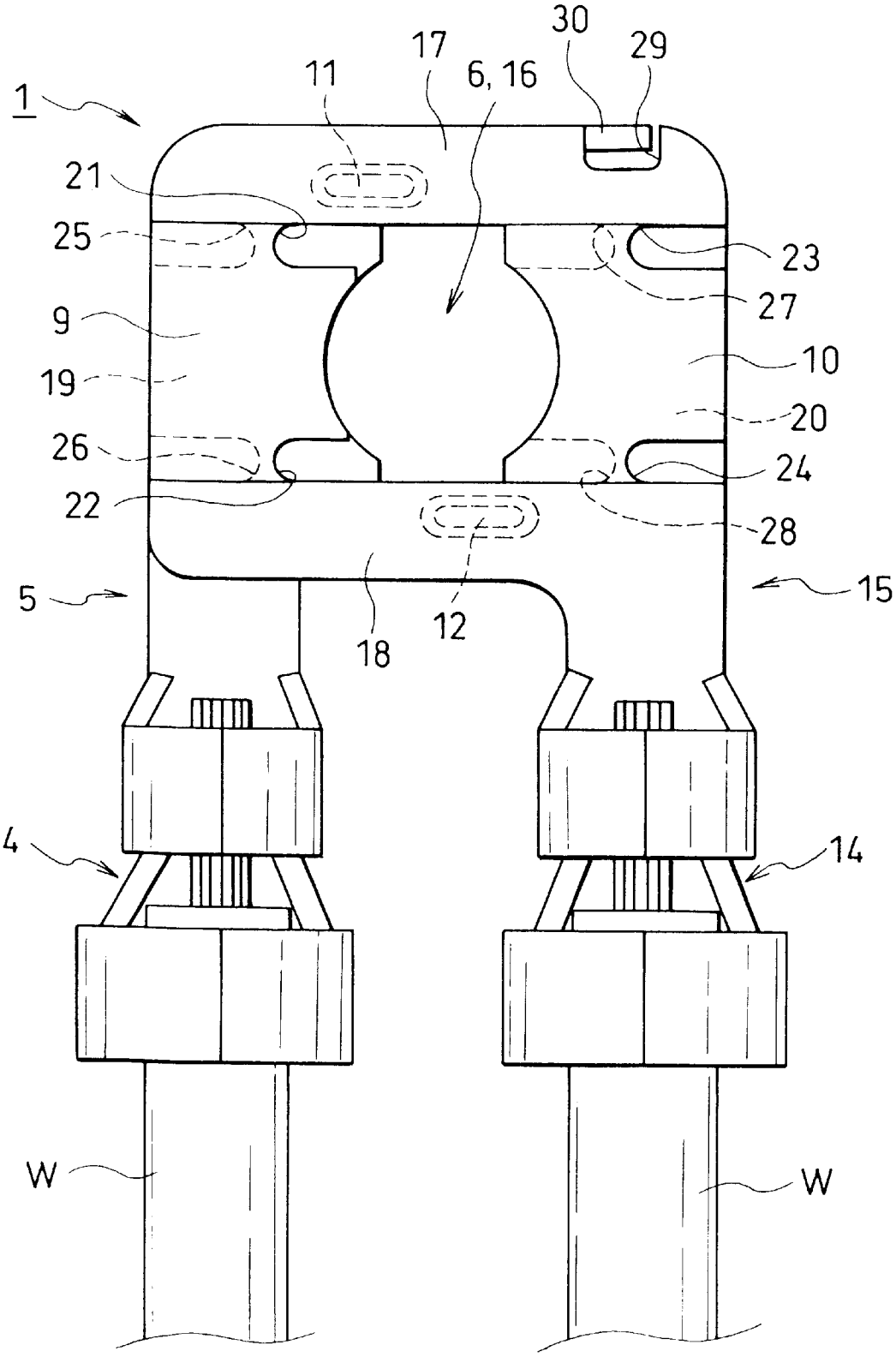
FIG. 2 is a plan view illustrating an assembled state in FIG. 1A.

As shown in FIGS. 1A and 2, a combination plate terminal assembly 1 in accordance with a first embodiment comprises one combination plate terminal 2 which includes a wire connecting portion 4 to be crimped onto an end portion of an electric wire W and an assembling portion 5 having in its center a through hole 6 through which a tightening bolt is inserted, as well as another combination plate terminal 3 which has a similar shape for fitting to a projecting inner surface of the one combination plate terminal 2.

The assembling portion 5 of the one combination plate terminal 2 has a pair of base plate portions 7 and 8 which extend in a direction substantially perpendicular to an extending direction of the wire connecting portion 4 with the through hole 6 positioned therebetween, and which are opposed to and are brought into close contact with a pair of base plate portions 17 and 18 (which will be described later) of the other combination plate terminal 3. Further, the assembling portion 5 of the one combination plate terminal 2 has a pair of retaining portions 9 and 10 which are respectively disposed in directions substantially parallel to the extending direction of the wire connecting portion 4 with the through hole 6 positioned therebetween and are fittable to a pair of retaining portions 19 and 20 (which will be described later) of the other combination plate terminal 3.

In addition, outer surfaces of the retaining portions 9 and 10 of the one combination plate terminal 2 are formed such that portions between the pair of base plate portions 7 and 8 project in a stepped form toward the other combination plate terminal 3 to such an extent as to form interference fits with respect to inner surfaces of the retaining portions 19 and 20. Further, a pair of elongated protrusions 11 and 12 are respectively provided projectingly on the base plate portions 7 and 8 at substantially intermediate positions between the retaining portions 9 and 10.

On the other hand, an assembling portion 15 of the other combination plate terminal 3 has the pair of base plate portions 17 and 18 which extend in a direction substantially perpendicular to an extending direction of the wire connecting portion 14 with a through hole 16 positioned therebetween, and which are opposed to and are brought into close contact with the pair of base plate portions 7 and 8 of the one combination plate terminal 2. Further, the assembling portion 15 of the other combination plate terminal 3 has the pair of retaining portions 19 and 20 which are respectively disposed in directions substantially parallel to the extending direction of the wire connecting portion 14 with the through hole 16 positioned therebetween and are fittable to the pair of retaining portions 9 and 10 of the one combination plate terminal 2.

In addition, the retaining portions 19 and 20 of the other combination plate terminal 3 are formed such that portions between the pair of base plate portions 17 and 18 project in a stepped form toward the one combination plate terminal 2 to such an extent as to form interference fits with respect to the retaining portions 9 and 10.

Further, the retaining portions 9, 10, 19, and 20 are respectively provided on both sides thereof with clearance grooves so that the corresponding retaining portions do not interfere with each other during fitting. During fitting, both combination plate terminals 2 and 3 are deflected in a state in which the base plate portions 7, 8, 17, and 18 at the innermost portions of the clearance grooves serve as fulcrums 21 to 28.

In addition, as locking mechanisms at the time when the assembling portions 5 and 15 are assembled, a locking groove 29 is provided in the base plate portion 7, while a flexible locking piece 30 corresponding thereto is provided on the base plate portion 17.

With the combination plate terminal assembly 1 having the above-described construction, the retaining portion 19 of the other combination plate terminal 3 with the rear wire connecting portion 4 crimped onto the end portion of the wire W is fitted in the through hole 6 by being moved along the outer surface of the retaining portion 10 of the one combination plate terminal 2 with the wire connecting portion 14 crimped onto the end portion of the wire W. Subsequently, if the retaining portion 19 of the other combination plate terminal 3 is continued to be fitted in such a manner as to traverse the through hole 6, the base plate portions 7 and 8 are respectively slid on the corresponding base plate portions 17 and 18. Then, the retaining portion 19 of the other combination plate terminal 3 slips in along the outer surface of the retaining portion 9 of the one combination plate terminal 2, while the other retaining portion of the other combination plate terminal 3 slips in along the outer surface of the other retaining portion 10 of the one combination plate terminal 2.

Since the retaining portions 9, 10, 19, and 20 are so set as to form interference fits as described above, their assembled state is not easily canceled, and the combination plate terminals 2 and 3 are positively assembled by the action of engagement between the locking piece 30 and the locking groove 29.

In that case, since the base plate portions 7 and 8 are provided with the protrusions 11 and 12, the base plate portion 7 is deflected at the fulcrums 21 and 23, and the base plate portion 17 is deflected at the fulcrums 25 and 27. Similarly, since the base plate portion 8 is deflected at the fulcrums 22 and 24, and the base plate portion 18 at the fulcrums 26 and 28, the combination of the combination plate terminals 2 and 3 is further stabilized.

In the combination plate terminal assembly 1 in this embodiment, the pair of protrusions 11 and 12 of the one combination plate terminal 2 are respectively projectingly provided on the base plate portions 7 and 8 of the one combination plate terminal 2 in such a manner as to be located substantially intermediately between the retaining portions 9 and 10 of the one combination plate terminal 2, i.e., substantially intermediately between the fulcrums 21 to 24.

Accordingly, the base plate portions 7, 8, 17, and 18 of the combination plate terminals 2 and 3 which are fitted and retained by assembling are pressed at three points including two fulcrums and one protrusion, so that it is possible to obtain satisfactory contact and stable electrical contact without being affected by the variation of the projecting height of the protrusions.

It should be noted that the combination plate terminal assembly in accordance with the present invention is not limited to the above-described first embodiment, and can be implemented by other forms by making appropriate changes.

Figure 1B:
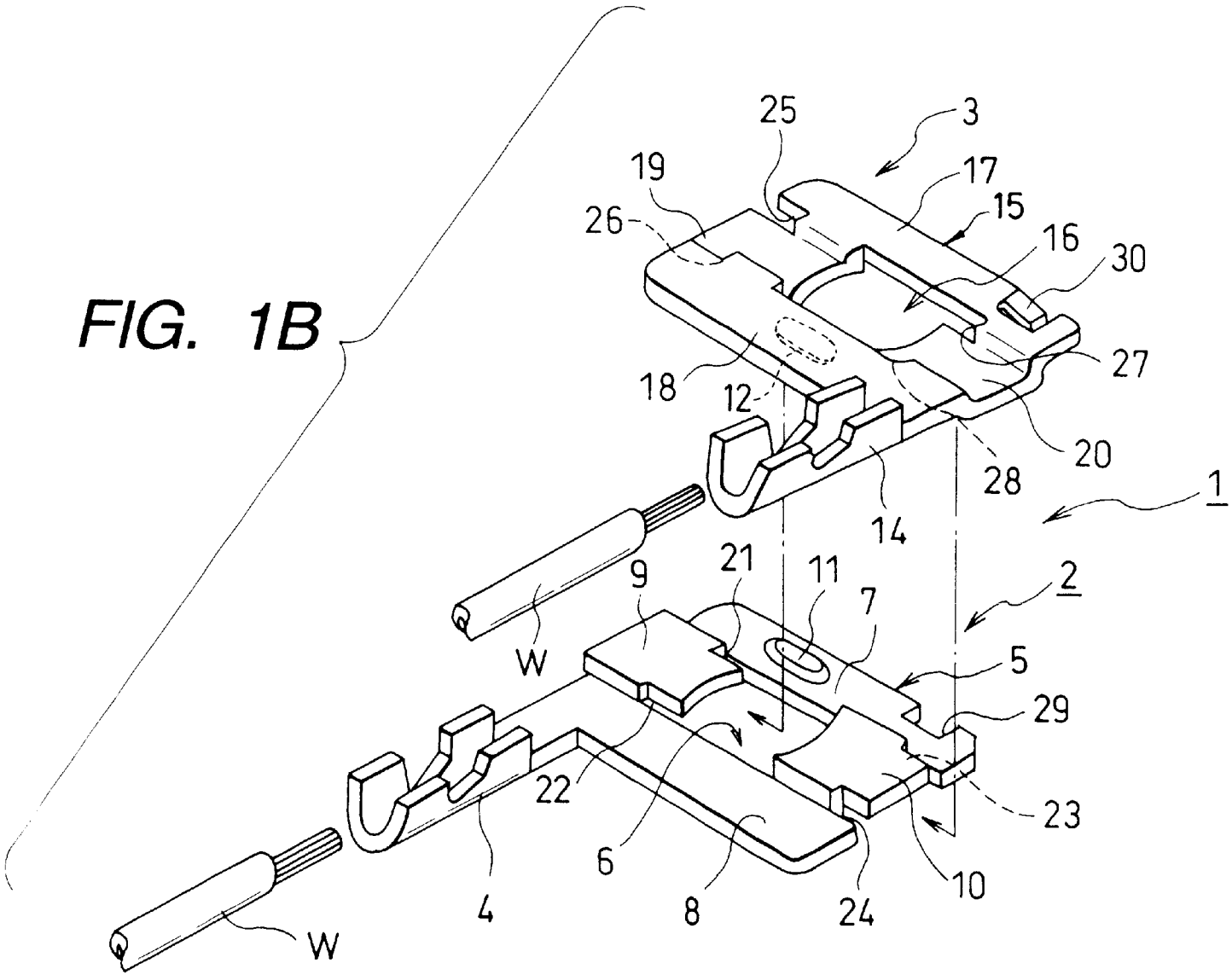
FIG. 1B is an exploded perspective view illustrating a modified example of the first embodiment of a combination plate terminal assembly shown in FIG. 1A.

FIG. 1B is an exploded perspective view illustrating a modified example of the first embodiment of a combination plate terminal assembly shown in FIG. 1A. As shown in FIG. 1B, for example, the protrusion 12 may be disposed on the base plate portion 18 instead of the base plate portion 8.

According to the first embodiment of the combination plate terminal assembly, the pair of protrusions are respectively projectingly provided on the base plate portions in such a manner as to be located substantially intermediately between the retaining portions (i.e., located adjacent to the through hole(s)) or located adjacent to the retaining portion (s). Hence, each of the base plate portions of the combination plate terminals, which are engaged by assembling, is pressed at three points including two fulcrums and one protrusion. Accordingly, it is possible to obtain satisfactory contact and stable electrical contact without being affected by the variation of the projecting height of the protrusions. Therefore, it is possible to obtain a highly reliable combination plate terminal assembly.

Next, referring to FIGS. 3A and 4, a description will be given of a combination plate terminal assembly 31 in accordance with a second embodiment of the present invention. This combination plate terminal assembly 31 has a form in which the lengths, in the directions substantially parallel to the extending directions of the wire connecting portions, of the retaining portions 10 and 20 of the above-described combination plate terminal assembly 1 are made short, and a retaining portion 32 of one combination plate terminal 42 and a retaining portion 33 of the other combination plate terminal 43 are formed.

Namely, the combination plate terminal assembly 31 adopts arrangements equivalent to those of the above-described combination plate terminal assembly 1 except that changes are made in fulcrums 34, 35, 36, and 37 whose intervals are made shorter than the intervals between the fulcrums 23 and 24 and between the fulcrums 27 and 28 in the abovedescribed combination plate terminal assembly 1, and that protrusions 38, 39, 40, and 41 are disposed parallel to phantom lines M and N which respectively connect the fulcrums 21 and 34 and the fulcrums 22 and 35 located at root portions of the retaining portions 9 and 32 of the combination plate terminal 42. Therefore, the identical parts and portions will be denoted by the same reference numerals, and a detailed description thereof will be omitted.

As described above, the combination plate terminal assembly 31 has the retaining portions 9, 32, 19, 33 whose lengths in the directions substantially parallel to the extending directions of the wire connecting portions are rendered differ, and the protrusions 38, 39, 40, and 41 are disposed parallel to the phantom lines M and N which respectively connect the fulcrums 21 and 34 and the fulcrums 22 and 35 located at the root portions of the retaining portions 9 and 32.

Accordingly, the deflecting direction of the base plate portions 7, 8, 17, and 18 coincides with the direction of the protrusions 38, 39, 40, and 41, so that contact areas of the protrusions 38, 39, 40, and 41 become uniform, thereby allowing the load at the time of assembling and bolting down to be distributed uniformly. Hence, crushing can be minimized, and contact areas become large, thereby making it possible to obtain stable electrical connection.

It should be noted that the combination plate terminal assembly in accordance with the present invention is not limited to the above-described second embodiment, and can be implemented by other forms by making appropriate changes.

Figure 3A:
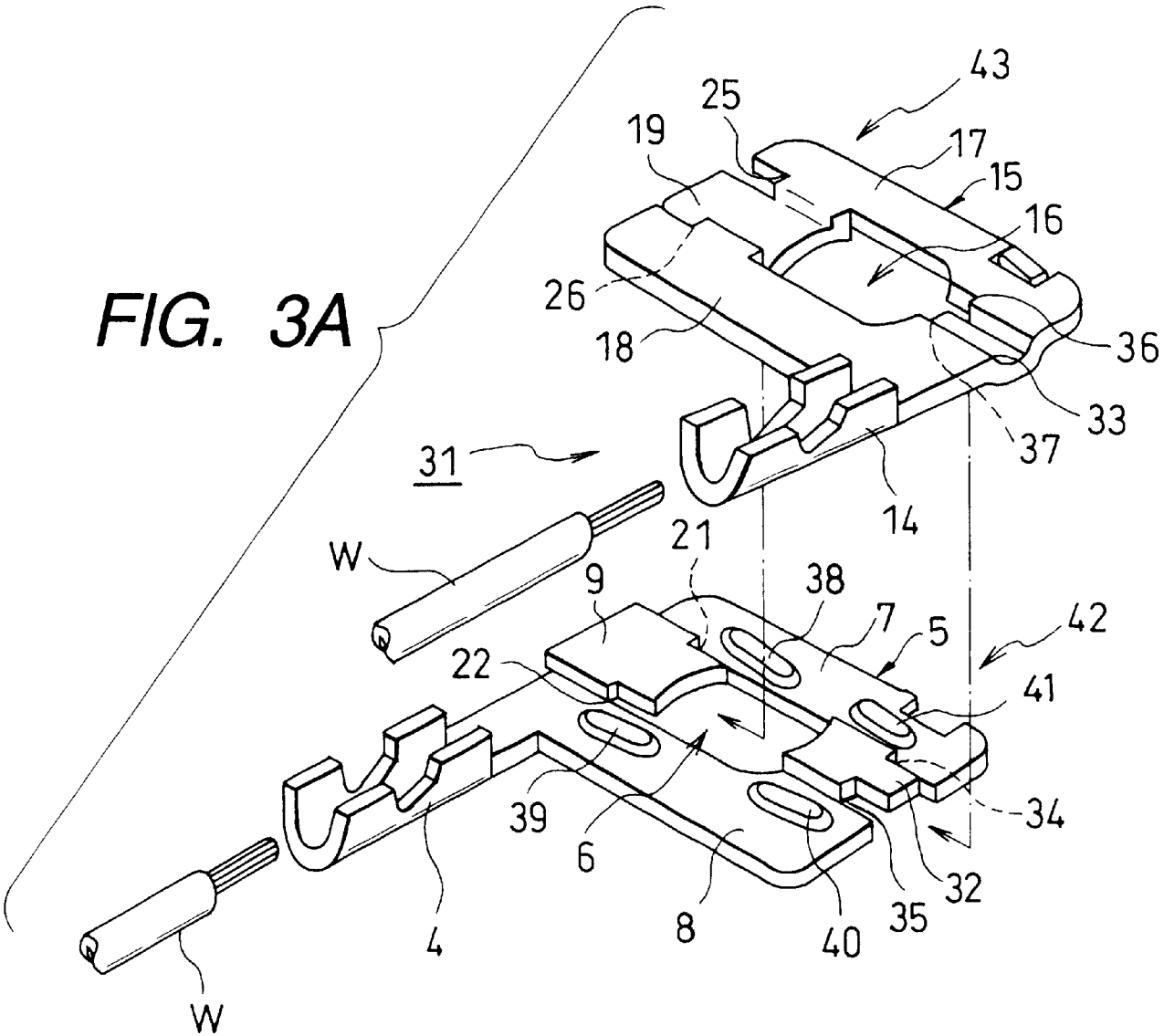
FIG. 3A is an exploded perspective view illustrating a second embodiment of the combination plate terminal assembly according to the present invention.
Figure 3B:
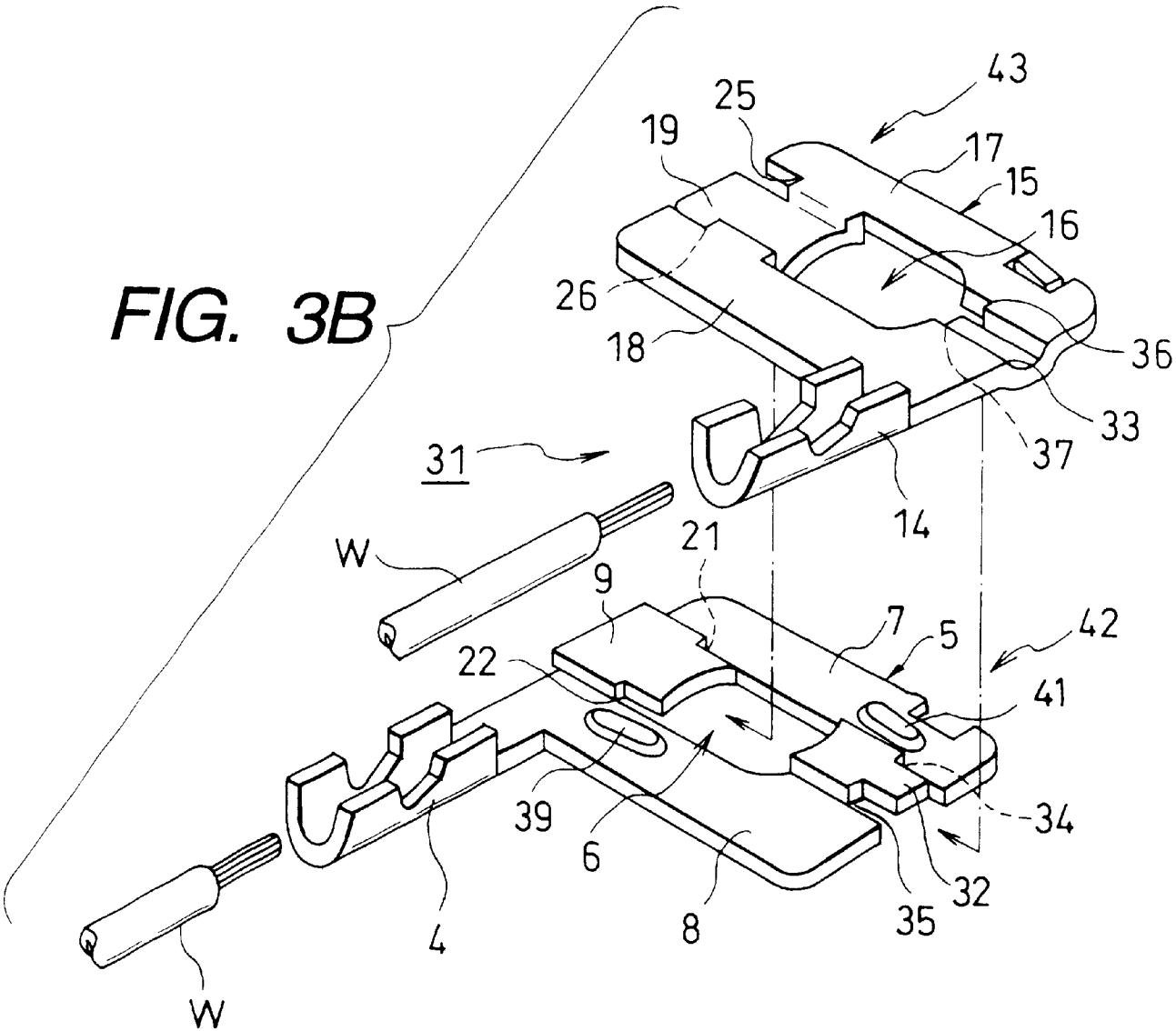
FIG. 3B is an exploded perspective view illustrating a modified example of the second embodiment of the combination plate terminal assembly shown in FIG. 3A.
Figure 4:
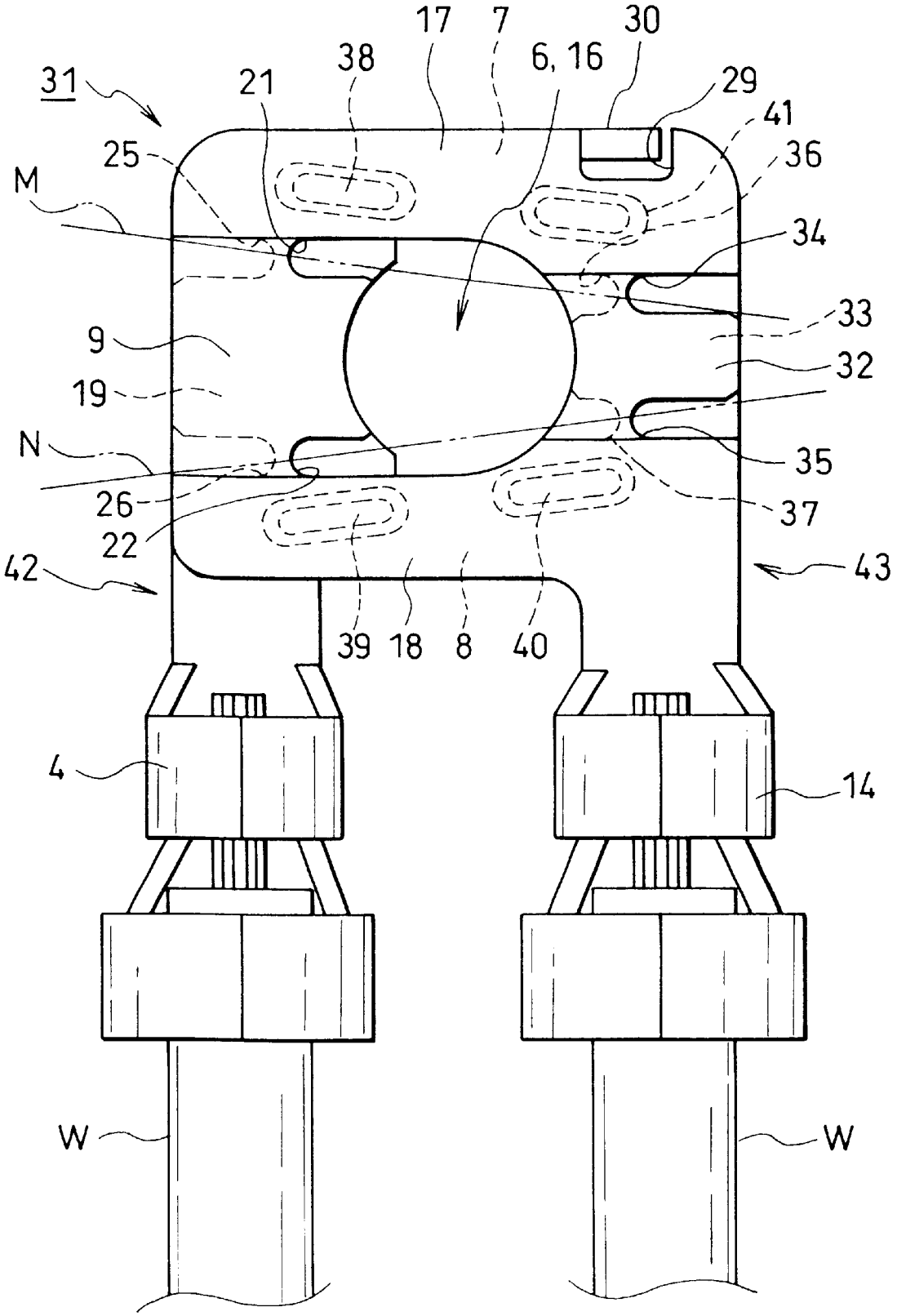
FIG. 4 is a plan view illustrating an assembled state in FIG. 3A.
Figure 5:
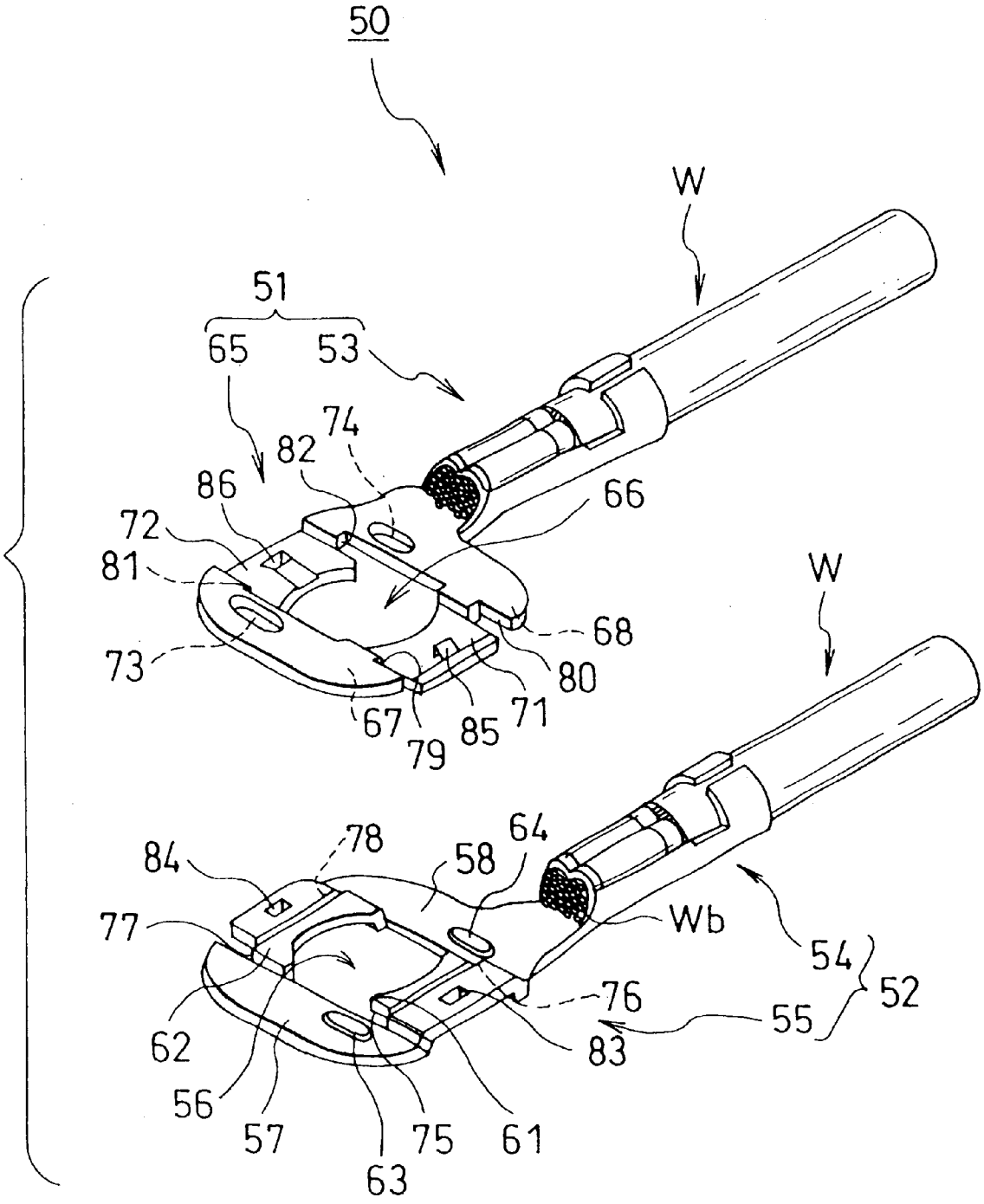
FIG. 5 is an exploded perspective view illustrating a related combination plate terminal assembly.
Figure 6:
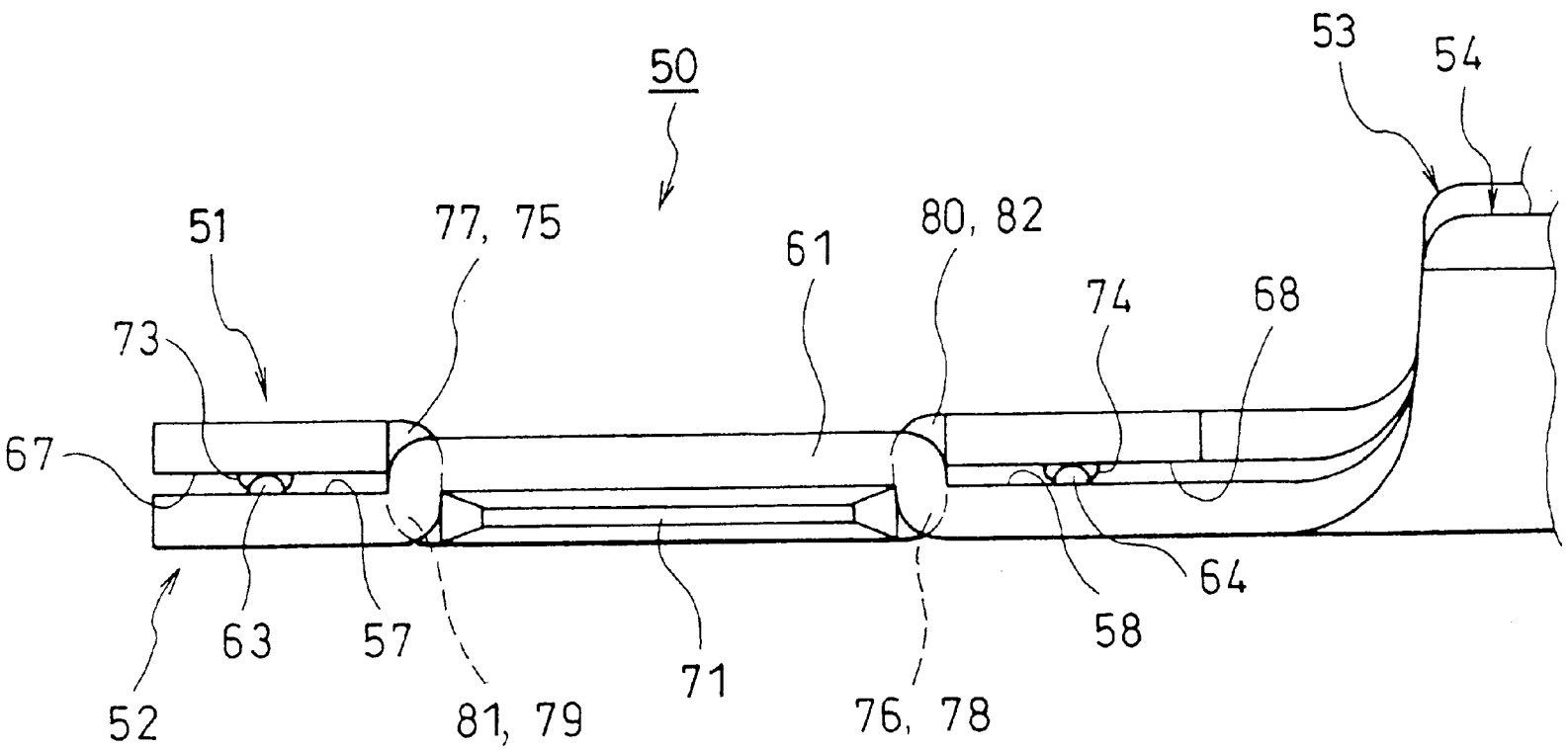
RELATED ART FIG. 6
FIG. 6 is a side elevational view illustrating an assembled state in FIG. 5.
Figure 7:
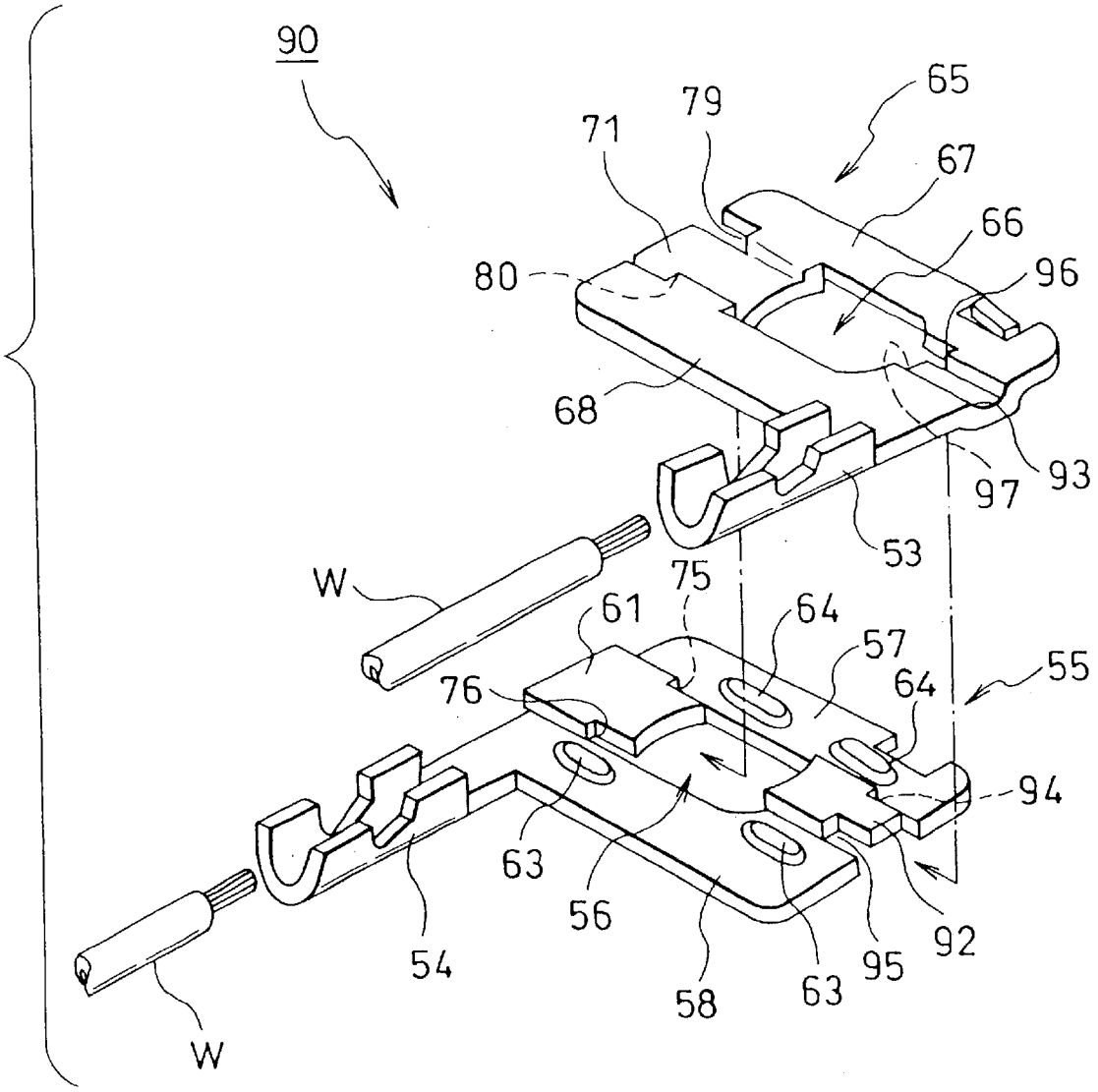
FIG. 7 is an exploded perspective view illustrating another related combination plate terminal assembly.
Figure 8:
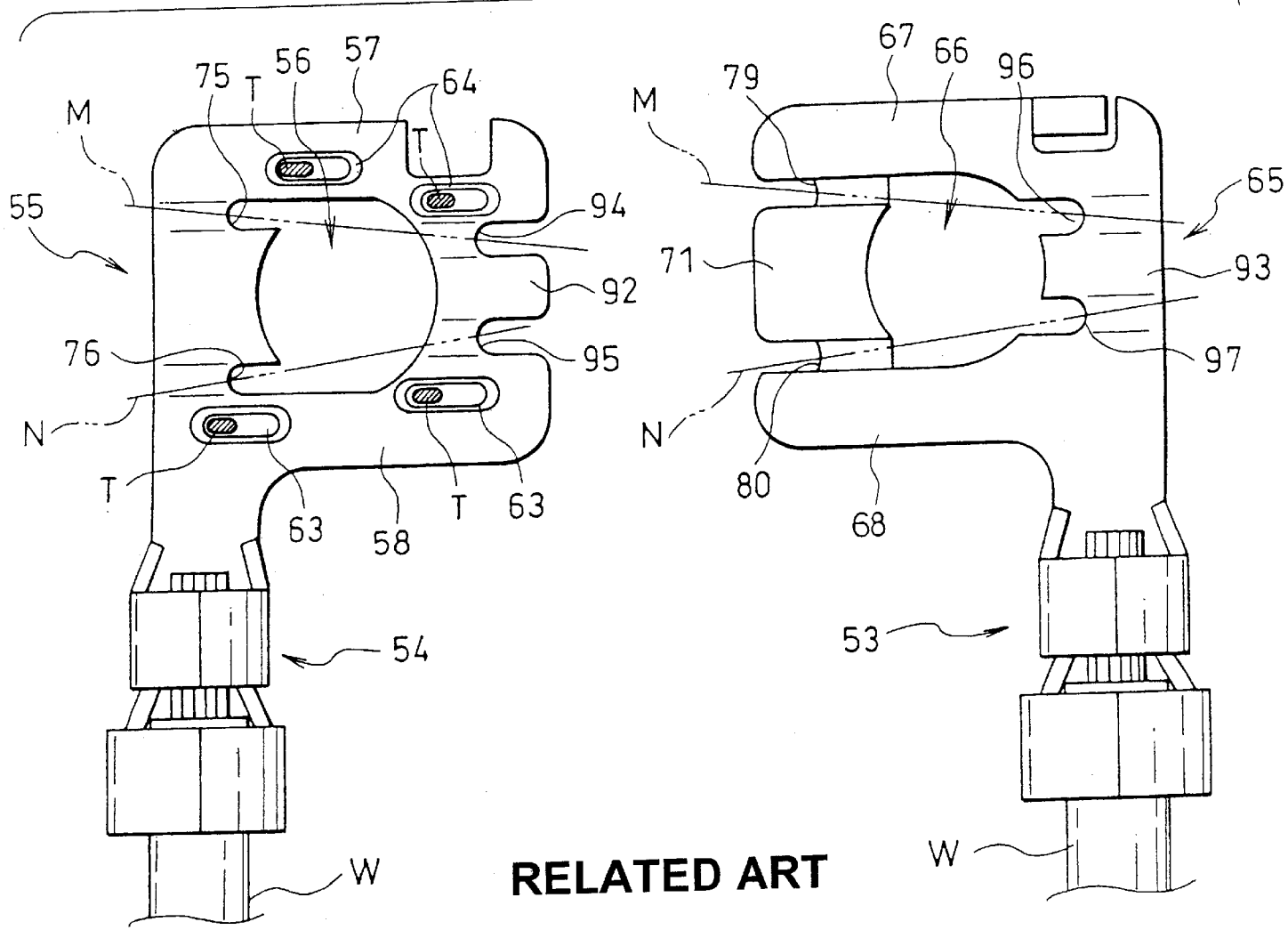
FIG. 8 is a diagram explaining the operation in FIG. 7.

FIG. 3B is an exploded perspective view illustrating a modified example of the second embodiment of the combination plate terminal assembly shown in FIG. 3A. As shown in FIG. 3B, for example, the number of the protrusions 38, 39, 40, and 41 may be reduced to one for each of the base plate portions 7 and 8 of the combination plate terminal 42.

Figure 3C:
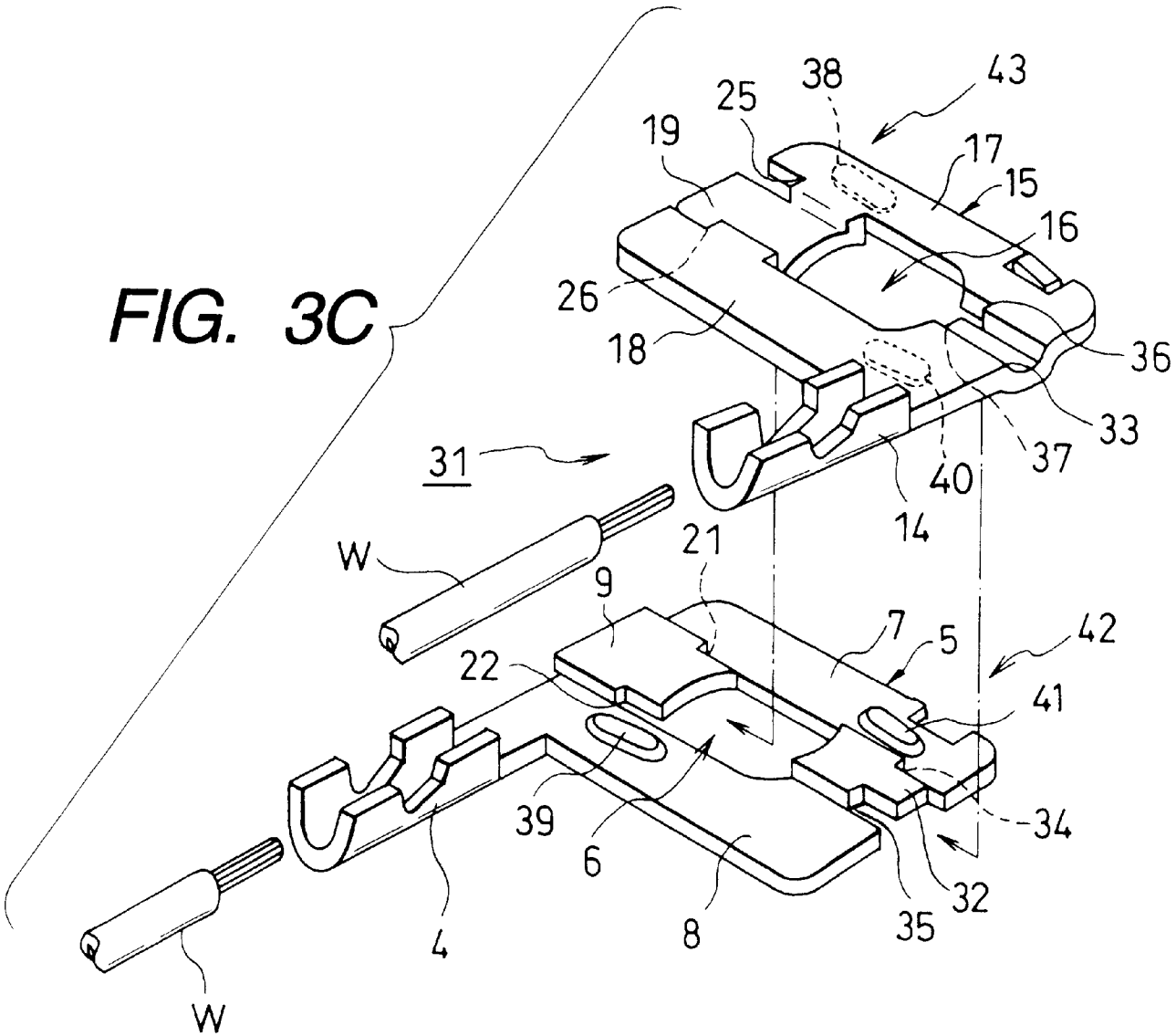
FIG. 3C is an exploded perspective view illustrating another modified example of the second embodiment of the combination plate terminal assembly shown in FIG. 3A.

FIG. 3C is an exploded perspective view illustrating another modified example of the second embodiment of the combination plate terminal assembly shown in FIG. 3A. As shown in FIG. 3C, for example, the protrusions 38 and 40 may be disposed on the base plate portions 17 and 18 instead of the base plate portions 7 and 8.

According to the second embodiment of the combination plate terminal assembly, the deflecting direction of each of the base plate portions coincides with the direction of each of the protrusions, so that contact areas of the protrusions become uniform, and the load at the time of assembling and bolting down can be distributed uniformly, so that crushing can be minimized. Further, since contact areas become large, it is possible to obtain satisfactory contact and stable electrical connection. Therefore, it is possible to obtain a highly reliable combination plate terminal assembly.

What is claimed is:

1. A combination plate terminal assembly, comprising:

a first combination plate terminal including:

a first wire connecting portion, to which an end portion of a first electric wire is connectable;

a first through hole, through which a tightening bolt is insertable;

a pair of first retaining portions, between which the first through hole is located, extending in a direction substantially parallel to an extending direction of the first wire connecting portion;

a pair of first base plate portions, between which the first through hole is located, extending in a direction substantially perpendicular to the extending direction of the first wire connecting portion; and at least one first elongated protrusion disposed on one of the first base plate portions; and a second combination plate terminal, with which the first combination plate terminal is engageable, wherein the at least one first elongated protrusion extends parallel to a first phantom line connecting first fulcrums formed between the first base plate portions and the second combination plate terminal when the first combination plate terminal and the second combination plate terminal are engaged with each other.

2. The combination plate terminal assembly of claim 1, wherein the second combination plate terminal includes:

a second wire connecting portion, to which an end portion of a second electric wire is connectable;

a second through hole, through which the tightening bolt is insertable;

a pair of second retaining portions, between which the second through hole is located, extending in a direction substantially parallel to an extending direction of the second wire connecting portion; and a pair of second base plate portions, between which the second through hole is located, extending in a direction substantially perpendicular to the extending direction of the second wire connecting portion.

3. The combination plate terminal assembly of claim 2, further comprising:

at least one second elongated protrusion disposed on one of the second base plate portions, wherein the at least one second elongated protrusion extends parallel to a second phantom line connecting second fulcrums formed between the first base plate portions and the second base plate portions when the first combination plate terminal and the second combination plate terminal are engaged with each other.

4. The combination plate terminal assembly of claim 3, wherein the at least one second elongated protrusion is located adjacent to either one of the second retaining portions.

5. The combination plate terminal assembly of claim 3, wherein portions of the first base plate portions and the second base plate portions adjacent to the first retaining portions and the second retaining portions serve as the first and second fulcrums for supporting an engagement of the first combination plate terminal and the second combination plate terminal.

6. The combination plate terminal assembly of claim 3, further comprising:

a third elongated protrusion disposed on the other one of the first base plate portions; and a fourth elongated protrusion disposed on the other one of the second base plate portions.

7. The combination plate terminal assembly of claim 1, further comprising:

at least one second elongated protrusion disposed on the other one of the first base plate portions, wherein the at least one second elongated protrusion extends parallel to a second phantom line connecting second fulcrums formed between the first base plate portions and the second combination plate terminal when the first combination plate terminal and the second combination plate terminal are engaged with each other.

8. The combination plate terminal assembly of claim 7, wherein the at least one second elongated protrusion is located adjacent to either one of the first retaining portions.

9. The combination plate terminal assembly of claim 7, wherein portions of the first base plate portions adjacent to the first retaining portions serve as the first fulcrums for supporting an engagement of the first combination plate terminal and the second combination plate terminal.

10. The combination plate terminal assembly of claim 7, further comprising:

a third elongated protrusion disposed on the one of the first base plate portions; and a fourth elongated protrusion disposed on the other one of the first base plate portions.

11. The combination plate terminal assembly of claim 1, wherein the at least one first elongated protrusion is located adjacent to either one of the first retaining portions.

12. The combination plate terminal assembly of claim 1, wherein when the first combination plate terminal and the second combination plate terminal are engaged with each other, portions of the first base plate portions and the second combination plate terminal adjacent to the first retaining portions serve as the first fulcrums for supporting an engagement of the first combination plate terminal and the second combination plate terminal.

* * * * *